United States Patent [19]

Greenwald

[11] 4,305,506

[45] Dec. 15, 1981

[54] INNER RETURN ENVELOPE NESTED IN OUTER ENVELOPE

[76] Inventor: Jonas Greenwald, 1 Prospect Park, SW., Brooklyn, N.Y. 11215

[21] Appl. No.: 21,544

[22] Filed: Mar. 19, 1979

Related U.S. Application Data

[63] Continuation-in-part of Ser. No. 934,794, Aug. 17, 1978, abandoned.

[51] Int. Cl.[3] ..... B65D 27/06

[52] U.S. Cl. ..... 206/632; 229/73; 229/92.7

[58] Field of Search ..... 229/73, 92.1, 92.3, 229/92.7; 206/632

[56] References Cited

U.S. PATENT DOCUMENTS

| | | | |
|---|---|---|---|
| 157,487 | 12/1874 | Bomar | 229/73 |
| 371,217 | 10/1887 | Procter | 229/73 |
| 1,164,606 | 12/1915 | Wittman | 229/73 |
| 1,397,880 | 11/1921 | Sanborn | 229/73 |
| 1,944,853 | 1/1934 | Unger | 229/92.1 |
| 1,995,183 | 3/1935 | Kovnat | 229/73 |
| 2,872,100 | 2/1959 | Coffin | 229/92.1 |
| 3,058,648 | 10/1962 | Alexander | 229/73 |
| 4,044,942 | 8/1977 | Sherwood | 229/73 |

*Primary Examiner*—Stephen P. Garbe
*Attorney, Agent, or Firm*—Peter L. Berger

[57] ABSTRACT

An envelope construction is disclosed in which an inner return envelope is nested. A foldable sheet is disclosed having an envelope built in as a one piece construction. The envelope is built in at the bottom of the sheet with a top opening flap for mailing. The top opening flap is a doubly extended flap that is sealed by glue upon mailing and the same flap is remoistened and sealed to permit the return of a reply envelope to the sender. The envelope can be formed from a single sheet during manufacture or from rolls of paper while cutting the rolls of paper. The envelope construction can also be formed by separate sheets. The envelope disclosed herein is valuable as mailers with within return envelopes for customer convenience in use.

11 Claims, 5 Drawing Figures

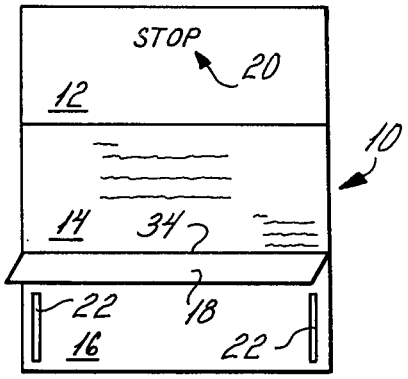
FIG. 1
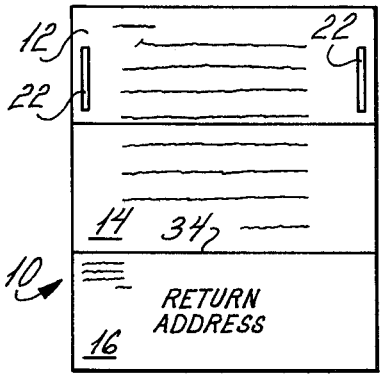
FIG. 2
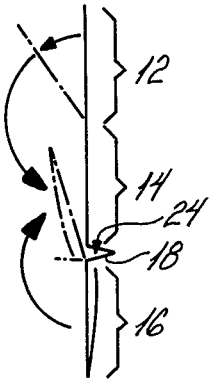
FIG. 3
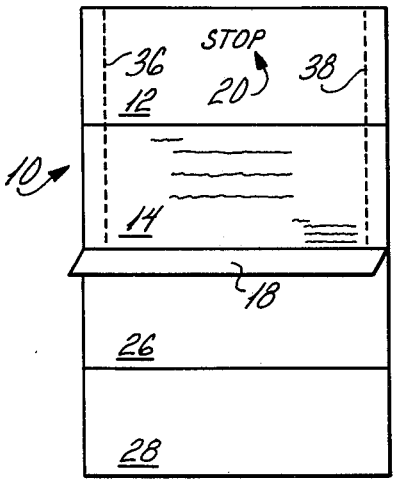
FIG. 4
FIG. 5
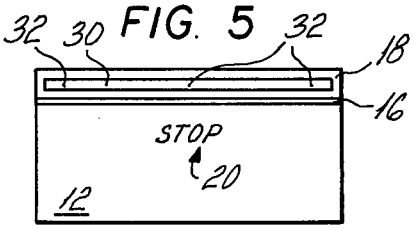

INNER RETURN ENVELOPE NESTED IN OUTER ENVELOPE

This application is a continuation-in-part application of my earlier filed application Ser. No. 934,794, filed Aug. 17, 1978, now abandoned.

I have invented an envelope with a double flap that is used two times due to the construction of the envelope and the gluing of the flap. The mechanical folding of the sheet under the doubly extending flap in conjunction with the sealing of the flap by glue or other material upon mailing and the remoistening of the same doubly extended flap to permit the return of a portion of the sheet or all of the sheet to the sender in the reply envelope is valuable as a round trip envelope or return mailer.

BRIEF DESCRIPTION OF THE DRAWINGS

FIG. 1 is a rear view of the envelope with top opening flap.

FIG. 2 is a front view of the envelope of FIG. 1.

FIG. 3 is a side view of the envelope of FIG. 1.

FIG. 4 is a rear view of the envelope with the inner envelope pouch being open and unglued.

FIG. 5 is a rear view of the outer envelope prior to sealing.

DETAILED DESCRIPTION OF THE INVENTION

Referring to the Figures, there is shown in FIG. 1 a rear view of the envelope construction of my invention. The envelope construction 10 comprises panels 12 and 14 and a return envelope 16. Panel 14 forms the address portion for the addressee receiving the envelope, an inner envelope 16 is folded into the panel 14 which is then folded into panel 12. The resulting construction is then folded under envelope flap 18 which seals the inner return envelope 16 and nests it within the folded panels. Flap 18 is secured at the top of panel 12. A warning printed indicia 20 located in the vicinity of the flap portion is placed there to direct the person receiving the envelope to lift the flap rather than tear it to open the outer envelope.

Referring to FIG. 2, there is shown a front view of the envelope with a printed message located on panel 12 as indicated therein. The inner nested envelope may have a return address preprinted thereon for ease of usage.

The envelope construction when folded may have normally open sides, but there may be provided glue strip areas 22 located on panel 12. When the envelope is initially sent out, glue strip areas 22 may be moistened to close the side edges of the outer envelope with the glue strips 22 being attached to the rear side of return inner envelope 16 and glue patches may be used instead of glue strips.

FIG. 3 illustrates the envelope construction of this invention being properly folded. When the envelope is initially received, flap 18 is lifted up and the lower panel 12 is opened as is panel 14. The message carrying on panel 12 and 14 may be viewed and a proper insertion may be made in return envelope 16 prior to its being reinserted in the mails. Thus, inner envelope 16 is located at the bottom of the envelope construction and is fixedly connected to the remainder of the envelope construction. Panel 14 and panel 12 are next sequentially located above inner envelope 16. Inner envelope 16 is folded upwardly to be positioned in contact with panel 14 and then panel 12 is folded over panel 14 to tuck under flap 18 enabling the envelope construction to be sealed.

The envelope may be formed of a single sheet properly folded to form the flap portions of the inner and outer envelopes as illustrated in FIG. 3 with a gluing of the flap portions taking place at location 24. Alternately the flap portions may be free to be separable to receive further printing thereon. Of course, the inner envelope may be formed from one sheet of material and the outer envelope formed from another with their respective flaps glued together to form flap 18.

Additionally, the outer envelope may be formed of more than two panels to carry additional message information, while the inner return envelope 16 may be formed of open panels as illustrated in FIG. 4. The inner envelope may be formed of panels 26 and 28 which may be folded at their common border to form an envelope under flap 18. In this fashion, if return information is to be indicated on the return inner envelope, this can be done prior to folding panel 28 under flap 18.

As illustrated in FIG. 5, flap 18 is formed of the flap portions of the inner and outer envelopes being joined or glued together. The inner and outer envelopes may be formed of separate sheets or may be formed of a single sheet as illustrated in FIG. 3. The flap so formed is provided with a common sealing strip portion 30 which may be spot moistened to accomplish the initial closure of the outer envelope as at spots 32-32-32. After strip 30 is so spot moistened, flap 18 is folded down to seal the outer envelope in cooperation with panel 12 and the envelope is then ready for its initial mailing. Upon receipt, the warning indicia 20 directs the recipient to lift flap 18 from panel 12. In this fashion, sealing strip portion 30 may be reused in cooperation with inner return envelope 16 by moistening the remainder of the strip portion to seal the inner envelope for its return.

As is clear, the message portion formed of panels 12 and 14 and any other panels is detachably removed from return envelope 16 along border region 34 as by perforating the interconnection or some other conventional arrangement, which serves as a detachable connecting means.

Additionally, the resealability achieved with flap 18 is illustrated by a seal strip initially being connected with spot moistening. Double seal strips may be provided to accomplish the same function, but the above-identified seal strip with spot moistening is a preferred embodiment.

The inner envelope has a width equal to the width of the outer envelope, in accordance with one preferred embodiment. In an alternative embodiment, and as illustrated in FIG. 4, perforation lines 36 and 38 are provided along the side edges of panels 12 and 14 so that the width of the panels is less than the width of the return envelope 16. In this fashion, the message portion may be folded only once to be reinserted in the envelope. Further, the message portion to be returned may comprise only panel 12, and if this is the case, then panel 12 may be detached from panel 14 by suitable means and no folding is required to insert the return portion 12 into return envelope 16 with perforation lines 36 and 38 indicated in FIG. 4.

It is intended to cover all the generic and specific features of the invention as here described as well as any statements of the scope of the invention which may fall there between.

The envelope disclosed herein is intended for use in a die cut manufacturing process and the sheet totally printed and constructed in Web high speed printing equipment as a computer printed envelope.

The envelope may also be used as a variable data envelope and as an office letter writing and billing document by secretaries. The envelope can be of great value in commerce and industry.

The integral envelope permits the transmital of articles along with a message and a reply to the sender. It is also known as a round trip envelope.

Also the envelope may be used as a greeting card, printed and formed by the above-described processes.

What is claimed is:

1. An envelope construction comprising an outer envelope formed of panels and a flap, with said panels being folded under said flap to form said outer envelope, said panels comprising a message portion formed of printable surfaces on which a printed message is carried, and an inner return envelope nested within said folded panels, said outer envelope having a flap portion and said inner envelope having a flap portion, both of said flap portions being connected together to form said envelope flap and having a common sealing strip portion for initially sealing said outer envelope and subsequently sealing said inner envelope, said sealing strip being resealable to close said inner envelope after being opened to display said message, and detachable connecting means enabling said message portion to be detached from said inner envelope.

2. An envelope construction as claimed in claim 1, wherein said common sealing strip portion comprises a single strip formed on said flap, said single strip being spot moistened to produce the initial sealing for said outer envelope, said flap being lifted to open said outer envelope, and said single strip being remoistened to seal said inner envelope.

3. An envelope construction as claimed in claim 2, further comprising warning indicia printed on said outer envelope in the vicinity of said resealable flap directing that said flap be lifted to open said outer envelope.

4. An envelope construction as claimed in claim 1, wherein said outer envelope comprises open sides to facilitate opening said outer envelope to display said printed message.

5. An envelope construction as claimed in claim 1, wherein the width of said inner envelope is equal to the width of said outer envelope.

6. An envelope construction as claimed in claim 1, wherein said envelope construction comprises a single elongated sheet of paper being folded to form said inner and outer envelope constructions.

7. An envelope construction as claimed in claim 1, wherein said inner and outer envelopes are formed of separate sheets of paper, said inner and outer envelopes being joined together by securing the respective flap portions of each together.

8. An envelope construction as claimed in claim 1, wherein said message portion comprises a perforated inner section having a width less than that of said inner envelope, whereby said perforated inner section may be placed in said inner envelope without being folded longitudinally.

9. An envelope construction as claimed in claim 1, wherein said outer envelope comprises side sealing means to seal said outer envelope.

10. An envelope construction as claimed in claim 1, wherein said inner envelope is formed of at least two panels being coextensive with corresponding panels of said outer envelope, said inner envelope being sealed along its side edges to form a closed return envelope.

11. An envelope construction as claimed in claim 1, wherein said inner envelope is formed of at least two inner panels, said inner panels being open to present an inner portion of said return envelope, said inner panels capable of carrying a message to be placed thereupon by the recipient of said outer envelope, said inner envelope being sealed by folding said inner panels and resealing said common sealing strip portion.

* * * * *